US006033349A

United States Patent [19]

Farenholtz

[11] Patent Number: 6,033,349

[45] Date of Patent: Mar. 7, 2000

[54] JOINT FOR RELEASABLY AND PIVOTALLY CONNECTING A MANNEQUIN TO A SUPPORT

[75] Inventor: Douglas William Farenholtz, Abbotsford, Canada

[73] Assignees: PTM Equipment Inc.,, Canada; Medical Plastics Laboratory, Inc., Gatesville, Tex.

[21] Appl. No.: 09/207,107

[22] Filed: Dec. 8, 1998

[51] Int. Cl.[7] ..... A63B 21/00

[52] U.S. Cl. ..... 482/83; 87/90; 472/441

[58] Field of Search ..... 482/83–90; 472/441, 472/445; 446/268

[56] References Cited

U.S. PATENT DOCUMENTS

| | | | |
|---|---|---|---|
| 3,281,148 | 10/1966 | Cummins | 482/83 |
| 3,399,891 | 9/1968 | McCormick et al. | 482/83 |
| 4,401,303 | 8/1983 | Anderson et al. | 482/83 |
| 5,254,062 | 10/1993 | Hoffman | 482/83 |
| 5,385,523 | 1/1995 | Forrest | 482/83 |
| 5,554,088 | 9/1996 | Zlojutro | 482/83 |
| 5,688,212 | 11/1997 | Walker | 482/83 |
| 5,863,279 | 1/1999 | Pouliot | 482/83 |

*Primary Examiner*—Jerome Donnelly
*Attorney, Agent, or Firm*—Merek & Voorhees

[57] ABSTRACT

A joint for releasably and pivotally connecting a mannequin to a support structure as might be used, for example in simulating martial arts skills such as those associated with judo, wrestling, jujitsu, akido, karate, taekwon do, etc. and other body contact sports including football, rugby and the like and in related testing, training and rehabilitative programs. The support structure includes a pivot member connected to the mannequin having a semispherical shaped pivot contact surface and an annular ring connected to the support having an annular ring contact surface for receiving the pivot member which permits circumductal rotation of the pivot member in the ring. A connector connects the pivot member to a resisting force which acts to constrain the pivot member within the ring against the ring contact surface and to permit pivotal movement of the pivot member within the ring against the force of the resisting force. A release member acts on the connector to release the resisting force from the pivot member to permit removal of the pivot member from the ring upon pivotal movement of the pivot member past a determined point, thereby releasing the mannequin from the base.

30 Claims, 9 Drawing Sheets

JOINT FOR RELEASABLY AND PIVOTALLY CONNECTING A MANNEQUIN TO A SUPPORT

BACKGROUND OF THE INVENTION

1. Field of the Invention

The present invention relates generally to testing and training aids that can be used in most body contact sports and more specifically to a martial arts and football training device which connects a mannequin to a support and allows the mannequin to pivot and be released from that support.

2. Description of the Prior Art

Martial arts testing and training devices in which a mannequin is used as a target are relatively well known in the art. These mannequins are usually attached to some support structure enabling a user to practice various martial arts skills on that mannequin as part of a testing or training regime.

A sample of one such martial arts training mannequin is disclosed in U.S. Pat. No. 5,700,230 to Cardona. Cardona discloses a martial arts training device which includes a moveable mannequin rotatably attached to a support base using a ball within a socket and a plurality of tension springs to retain the mannequin in a generally upright position following deflection thereof. However Cardona does not teach the use of a mannequin connected to a support structure in which the mannequin may be removed from that support structure as a part of a testing or training martial arts skill attempted by a user.

U.S. Pat. No. 3,861,676 to Paul discloses the use of a life-like human form mannequin attached to a base plate by a > "snap button-like connection in the form of complimentary male and female members, so that the body will be disconnected from the plate upon application of sufficient force to lift the body from the plate". (from the Abstract)

Paul's mannequin suffers from several disadvantages:

1. There is no means for adjusting the force required to release the mannequin from the plate;
2. The mannequin is not rotatable or deflectable with respect to the plate;
3. The mannequin is not rotatable or deflectable about a large range of movement before force would cause the release of the mannequin from the support as movement depends on the resiliency of the material making up the mannequin and the base;
4. The mannequin, being releasably attached at its feet is not able to rotate about its centre of gravity and must be lifted clear of the snap fixture to be released. This precludes use of the mannequin for releasing upon lower body impact such as that of leg and foot sweeps and trip skills common to many martial art programs and skills; and
5. The mannequin is supported and released at the feet of the mannequin, some distance from its centre of gravity which provides a less realistic application of force for releasing the mannequin, as compared to one in which the mannequin is supported near the centre of gravity of the mannequin.

U.S. Pat. No. 2,913,245 to Landis discloses a football training device comprising a rigid vertical supporting member, a tackling bag on said supporting member, anchoring means, a universal pivotal connection between said supporting member and the anchoring means. U.S. Pat. No. 3,659,847 issued to Gow, discloses an apparatus for improving and training football players in blocking and tackling employing an elevated horizontal member rotatable in a horizontal plane about a point intermediate its ends. One end of the member is spring loaded and a counterbalanced tackling dummy hangs on pulleys below the opposite end of the member. Another reference to connecting devices for connecting objects to supporting members is found in Kelly, Jr. U.S. Pat. No. 3,649,016 which discloses a padded dummy attached to a movable frame which slides longitudinally and swings from side to side in the frame. Hooker, in U.S. Pat. No. 3,464,696, describes a football tackling dummy apparatus comprising a supporting structure, a substantially horizontal track, and means pivotally supporting one end of the track upon the supporting structure with a dummy rigidly suspended perpendicularly from the carriage.

None of these inventions provide a reliable training mannequin which would simulate the realistic displacement of an opponent and ultimately throwing an opponent (or ball carrier) to the ground such as is allowed or required by rules common to a number of body contact sports such as football and rugby.

As a consequence, there is need for a mannequin mounting and release mechanism which is pivotally attached to a variable resistance support mechanism permitting the user to choose the level of resistance and the extent of deflection of the mannequin. Deflection past a pre-determined point causes the mannequin to be released from the support mechanism so that the mannequin can be thrown to the ground or mat surface and permit the user to continue the application of various skills on the ground or mat.

BRIEF SUMMARY OF THE INVENTION

It is often desirable in simulating various martial arts moves or moves associated with other body contact sports, such as in football and rugby, to provide for the release of the mannequin from its support structure as a part of that move. For example a user may wish to strike or push the mannequin in a particular direction against a pre-determined resisting force and beyond a pre-determined amount of deflection to cause the release of the mannequin from the support to enable a user to flip the mannequin from the base onto the floor.

The present invention provides a mannequin which is secured to a support which enables pivotable movement of the mannequin about the support in virtually all directions about a horizontal plane and which permits the release of the mannequin from the support upon deflection of the mannequin beyond a predetermined point. Furthermore, deflection of the mannequin prior to its release occurs against a resisting force of predetermined adjustable amount to provide more realistic simulation of a real martial arts action against a person represented by the mannequin.

A joint for releasably and pivotally connecting a mannequin to a support is provided which includes a pivot member having a semi-spherically shaped pivot contact surface connected to the mannequin, an annular ring connected to the support comprising an annular ring contact surface for receiving the pivot member, the ring contact surface dimensioned to support the pivot member and to permit pivotal movement of the pivot member within the ring, a resisting force, a connector connecting the pivot member to the resisting force the resisting force acting on the connector to constrain the pivot member within the ring against the ring contact surface and to permit pivotal movement of the pivot member within the ring against the force of the resisting force and a release member acting on the connector to release the resisting force from the pivot member to permit removal of the pivot member from the ring upon pivotal movement of the pivot member past a predetermined point.

DETAILED DESCRIPTION OF THE PREFERRED EMBODIMENT(S)

Figure 1:
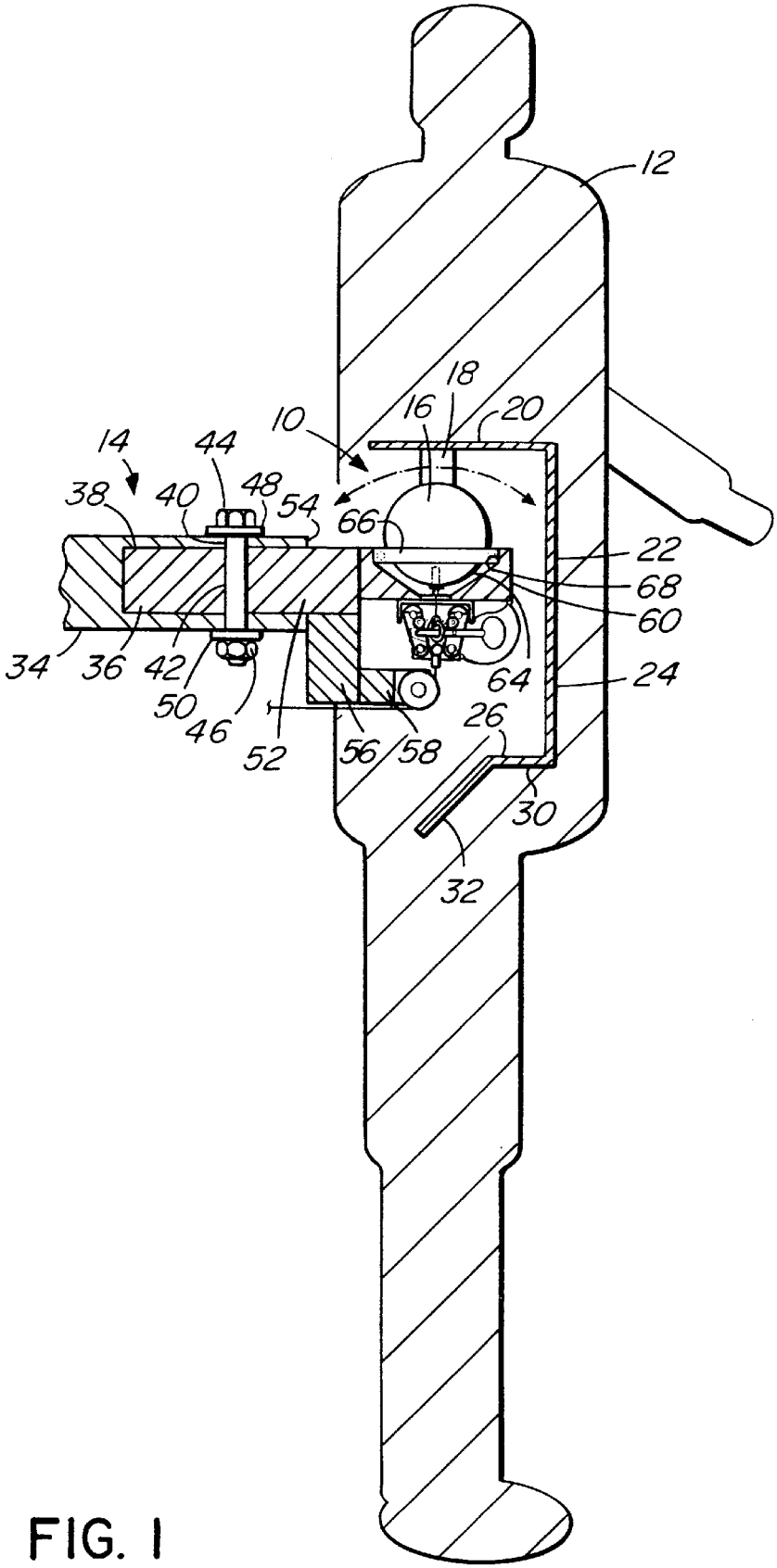
FIG. 1 is a side view of the joint of the present invention, connecting a mannequin to a support, prior to release of the mannequin from the support.
Figure 2:
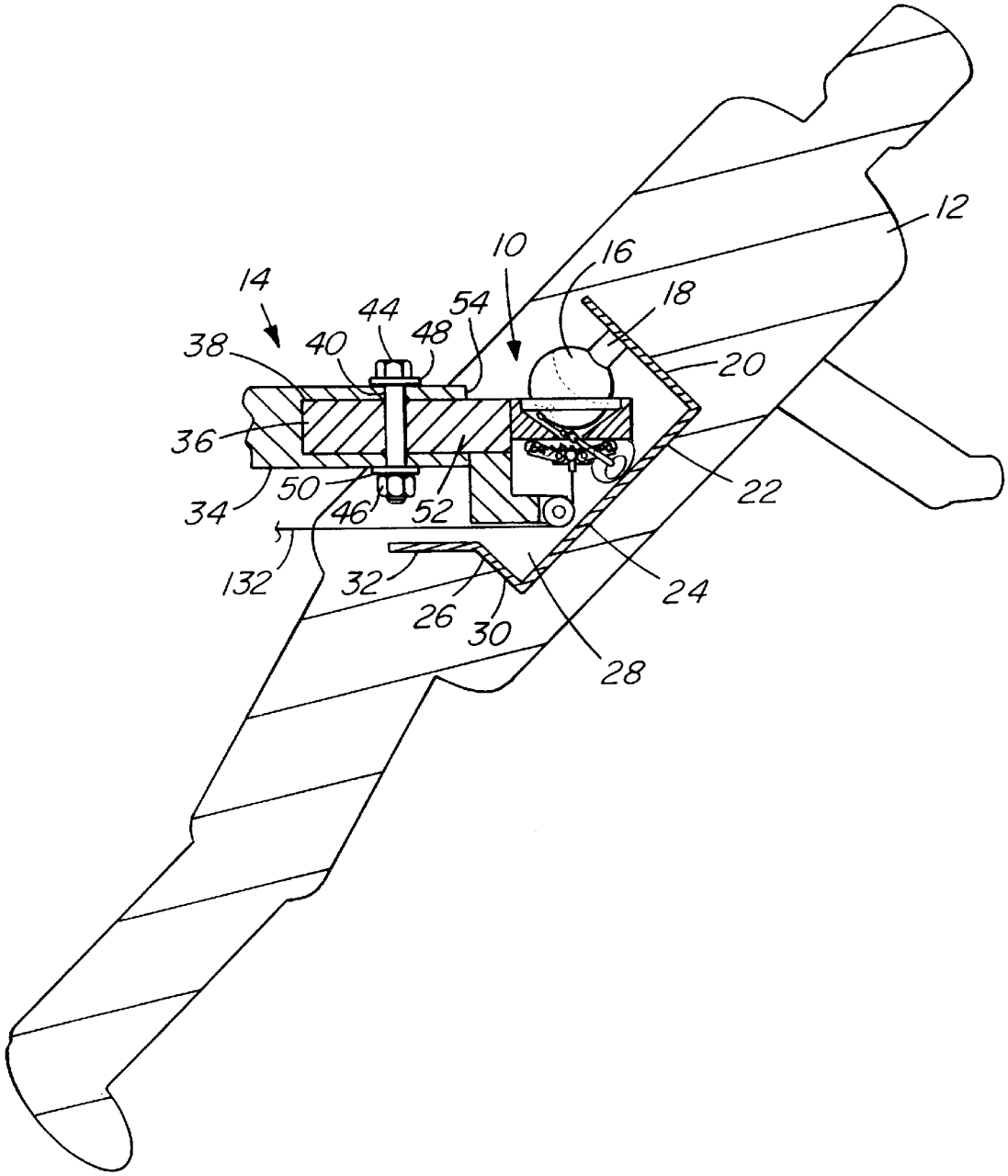
FIG. 2 is a side view of the joint of the invention of FIG. 1, with the mannequin in a deflected position, prior to release of the mannequin from the support.
Figure 3:
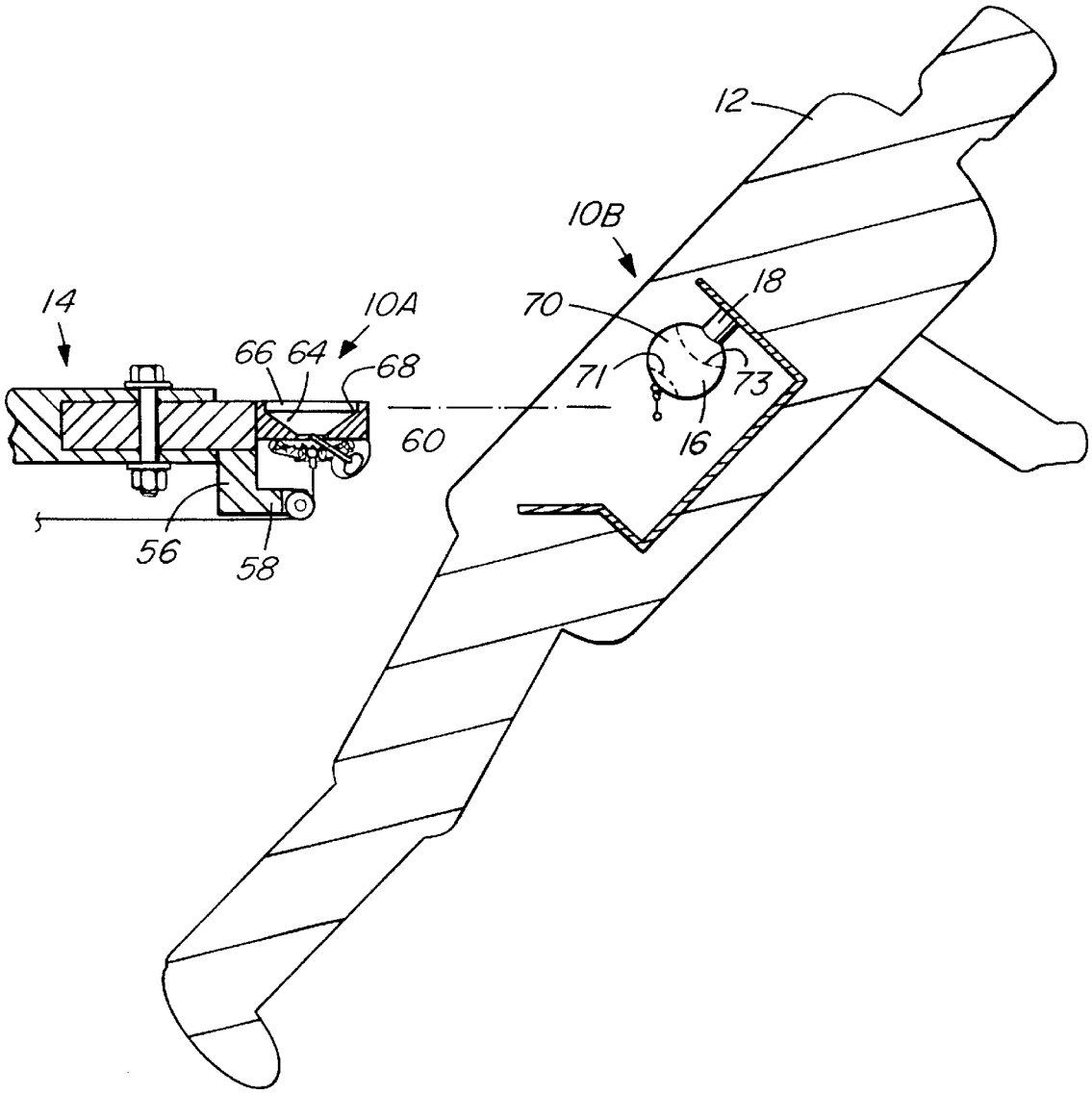
FIG. 3 is a side view of the joint of the invention of FIG. 1, with the mannequin separated from the support.

FIGS. 1, 2 and 3 depict joint 10 interposed between mannequin 12 and support 14, in successive orientation of mannequin 12 as mannequin 12 is pivoted about joint 10 with respect to support 14. FIG. 1 depicts mannequin 12 in its upright, normal position prior to contact by the user. FIG. 2 depicts mannequin 12 in a deflected position just prior to release of mannequin 12 from support 14. FIG. 3 depicts mannequin 12 released from support 14 and separated therefrom.

As depicted in FIG. 3, certain components 10A of joint 10 remain attached to support 14 and the other components 10B of joint 10 remain attached to mannequin 12, when mannequin 12 is released and separated from support 14, as depicted in FIG. 3.

Referring to FIGS. 1 and 2, joint 10 is generally comprised of pivot member 16 connected to mannequin 12 by means of mount 18. Mount 18 is attached to upper side 20 of housing 22. Housing 22 comprises upper side 20, front side 24 and angled lower side 26, depicted in FIG. 1, and left side 27 and right side 29, depicted in FIG. 5. Housing 22 is rigidly secured within mannequin 12 and forms cavity 28 in mannequin 12.

As seen in FIG. 2, lower side 26 includes front portion 30 connected to front side 24 and oriented generally horizontally when mannequin 12 is in its normal position (depicted in FIG. 1). Lower side 26 further includes rear portion 32 angled downwardly and rearwardly with respect to front portion 30. This permits rotation of mannequin 12 from its normal position, depicted in FIG. 1, to its release position deflected slightly more than as depicted in FIG. 2.

Support 14 includes arm 34 which may be attached to various supporting structures such as a wall or a power testing and training machine as described in U.S. Pat. Nos. 4,951,943, 5,050,872, and 5,152,733. Inner flange 36 is slidable within cavity 38 formed within arm 34. Arm 34 and flange 36 include openings 40 and 42 respectively, which are in alignment when flange 36 is completely within cavity 38. This enables bolt 44 to slide through openings 40 and 42. Nut 46 may be fastened to threaded end of bolt 44 to secure inner flange 36 to arm 34. Flat washer 48 and lock washer 50 may be interposed at each end of bolt 44 to facilitate securing of flange 36 to arm 34. The outer end 52 of flange 36 extends beyond the outer end 54 of arm 34. Vertical member 56 extends downwardly from end 52. Horizontal member 58 extends horizontally and outwardly from the lower end of member 56.

Ring support 60 having a generally flat lower surface 62 extends horizontally and outwardly from end 52. Lower surface 62 acts as a contact member as will be described below with respect to the release member.

The upper surface of ring support 60 is generally spherical in shape with cavity 64 formed therein. Ring 66 extends from one side of cavity 64 to the other and is supported by shoulder 68 in cavity 64.

As seen best in FIG. 3, pivot member 16 is generally spherical in shape and includes a spherical zone shaped pivot contact surface 70 about its periphery. Pivot contact surface 70 contacts annular ring contact surface 72 (FIGS. 8 and 9) and is dimensioned to support pivot member 16 within ring 66 and permit pivotal movement of pivot member 16 within ring 66.

Cable 132 acts as a connector connecting the resisting force (not shown) to pivot member 16. The resisting force can be a weight stack, a spring, resilient material or other known devices for providing a resisting force.

Figure 4:
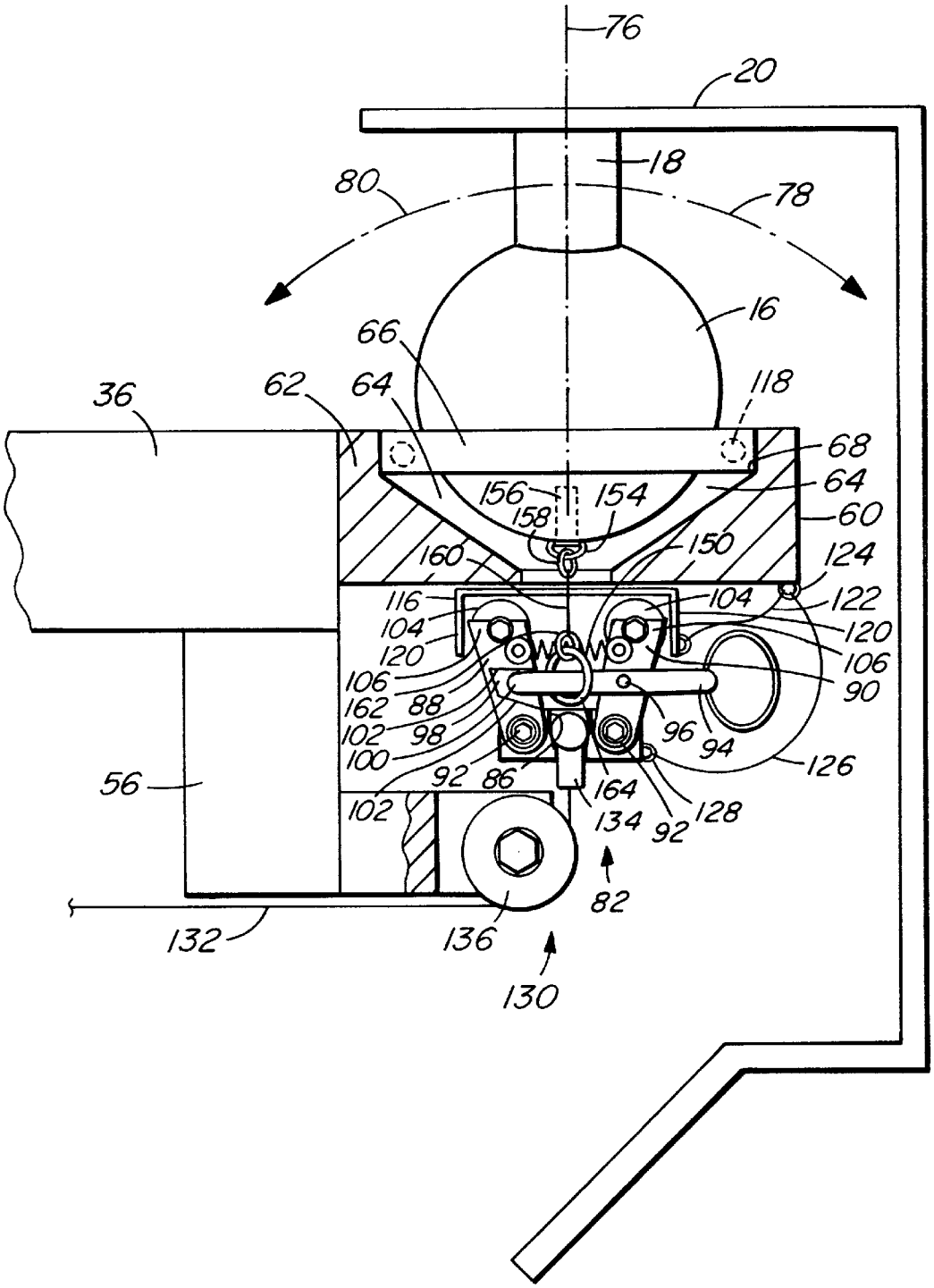
FIG. 4 is a close-up side view of the joint of the invention of FIG. 1, in an undeflected position with the mannequin attached to the support.
Figure 6:
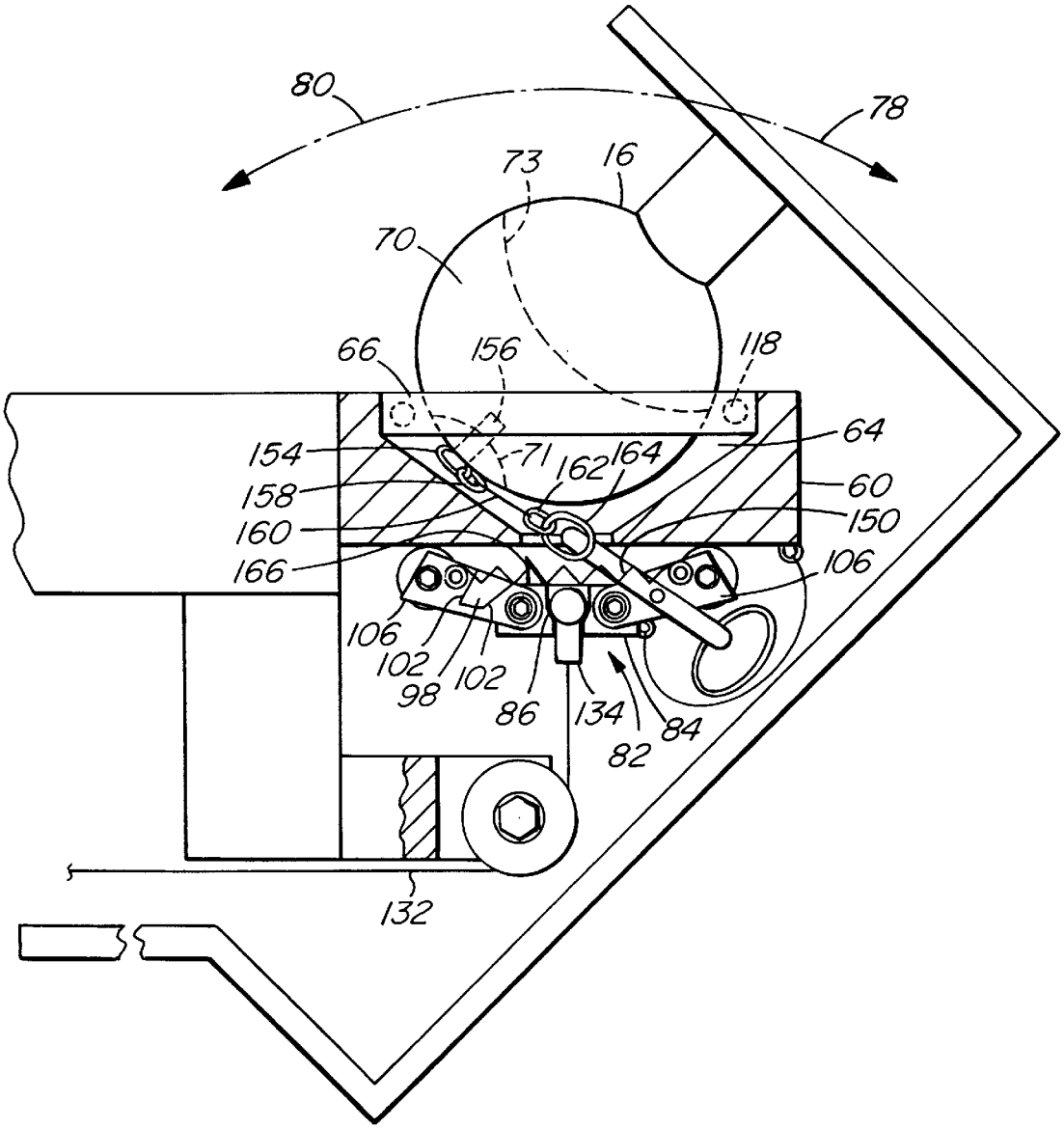
FIG. 6 is a close-up side view of the joint of FIG. 1 in a deflected position just prior to release of the mannequin from the support.

FIG. 4 depicts the joint 10 of the present invention including pivot member 16 rotatable within ring 66 circumductally in all directions about its central axis 76 within a pivot contact surface 70 between lower line 71 and upper line 73 (FIG. 6). For example, one such direction 78 is shown in dotted lines as well as its opposite direction 80. It can be seen more clearly in FIG. 4 that ring 66 is supported solely by shoulder 68 and that pivot member 16 is seated within ring 66, also supported by shoulder 68. Cavity 64 is large enough to permit unimpeded rotational movement of pivot members 16 in any direction about axis 76. Deflection of pivot member 16 with respect to ring 66 in direction 78 is depicted in FIG. 6. It will further be seen from FIG. 6 that cavity 64 is sufficiently large to permit components of the release member 82 adjacent pivot member 16 to enter cavity 64 and move with pivot member 16 without contacting the upper surface of support 60.

Figure 5:
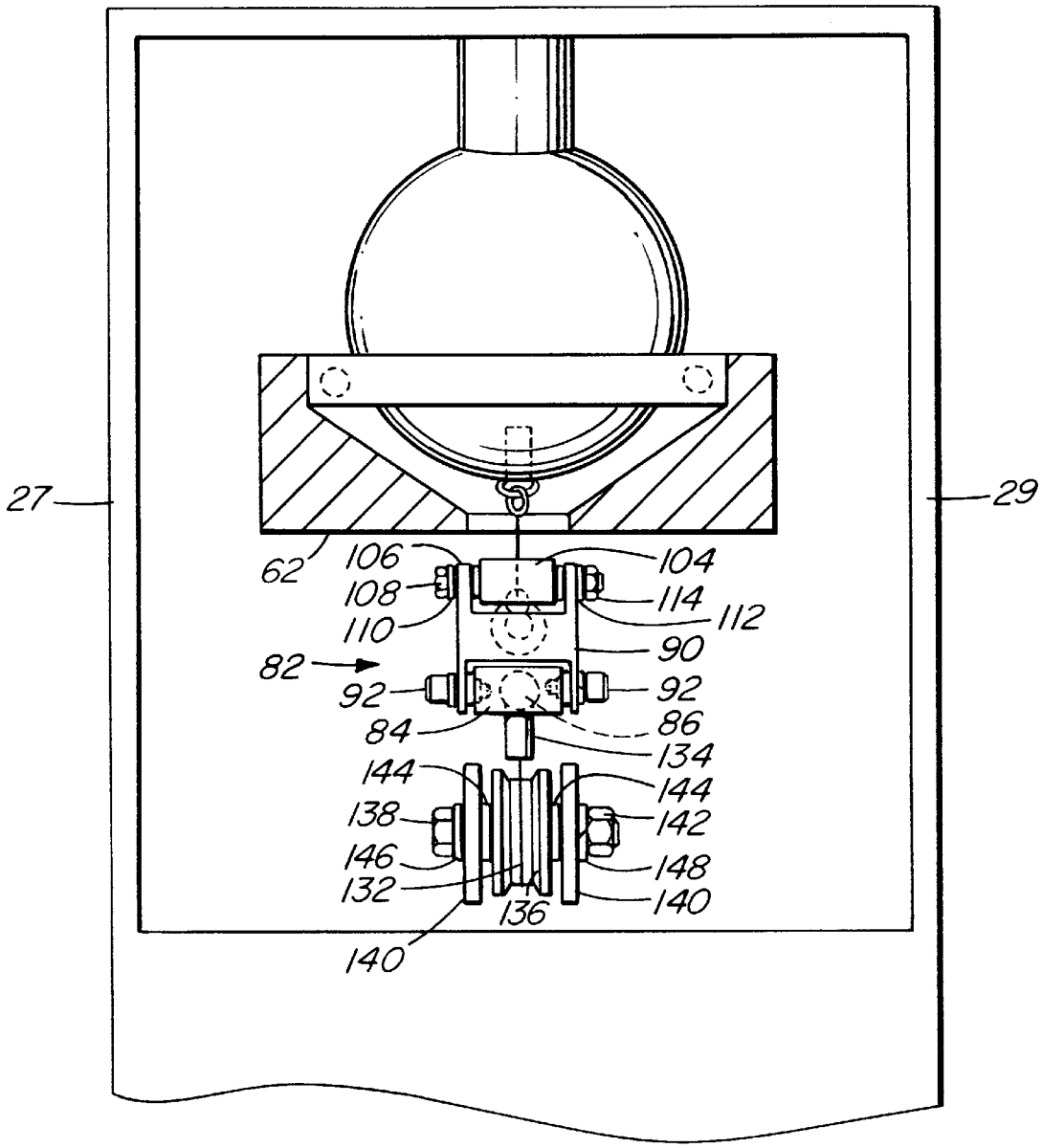
FIG. 5 is a close-up front view of the joint of FIG. 1, in an undeflected position with the mannequin attached to the support and showing a lock preventing deflection of the mannequin.

FIGS. 4 and 5 depict close-up views showing the details of release member 82. Release member 82 includes release member base 84 of generally rectangular shape containing swag receiving slot 86 in a side thereof. A pair of opposed generally upstanding trigger members 88 and 90 are pivotally connected to base 84 by means of bolt 92. As seen in FIG. 4, trigger members 88 and 90 are oriented slightly outwardly away from each other when in the normal position prior to deflection of pivot member 16. Release pin 94 is rotatably connected to trigger member 90 at pivot connection 96. Trigger member 88 includes slot 98 positioned to accept the inner end 100 of pin 94. The walls 102 of slot 98 are angled to provide a larger opening at the inner side of trigger member 88 to facilitate entry of pin 94 when resetting mannequin 12 on support 14, as described below. The upper end of each trigger member 88 and 90 includes roller 104 rotatably attached to upper ends 106 of trigger members 88 and 90. As seen best in FIG. 5, rollers 104 are generally cylindrical in shape and are rotatably attached to ends 106 by means of bolt 108, flat washer 110 at one end and lock washer 112 and nut 114 at the other end.

As seen in FIGS. 4 and 5, rollers 104 are oriented below lower surface 62 of ring support 60. Sufficient space is provided between rollers 104 and surface 62 to permit insertion of lock 116 there between. Lock 116 includes lateral flanges 120 which fit adjacent the outer sides of rollers 104 and prevent outer movement of rollers 104 when trigger members 88 and 90 are forced upwardly when force is applied on mannequin 12 against the resisting force. Lock 116 is connected to support 60 by means of cable 122 attached to connector 124 which retains lock 116 adjacent support 60 when lock 116 is not in place about rollers 104. Similarly, cable 126 connects connector 124 and support 60 and connector 128 of base 84 to retain base 84 adjacent support 60 when pivot member 16 is released from ring 66.

Figure 8:
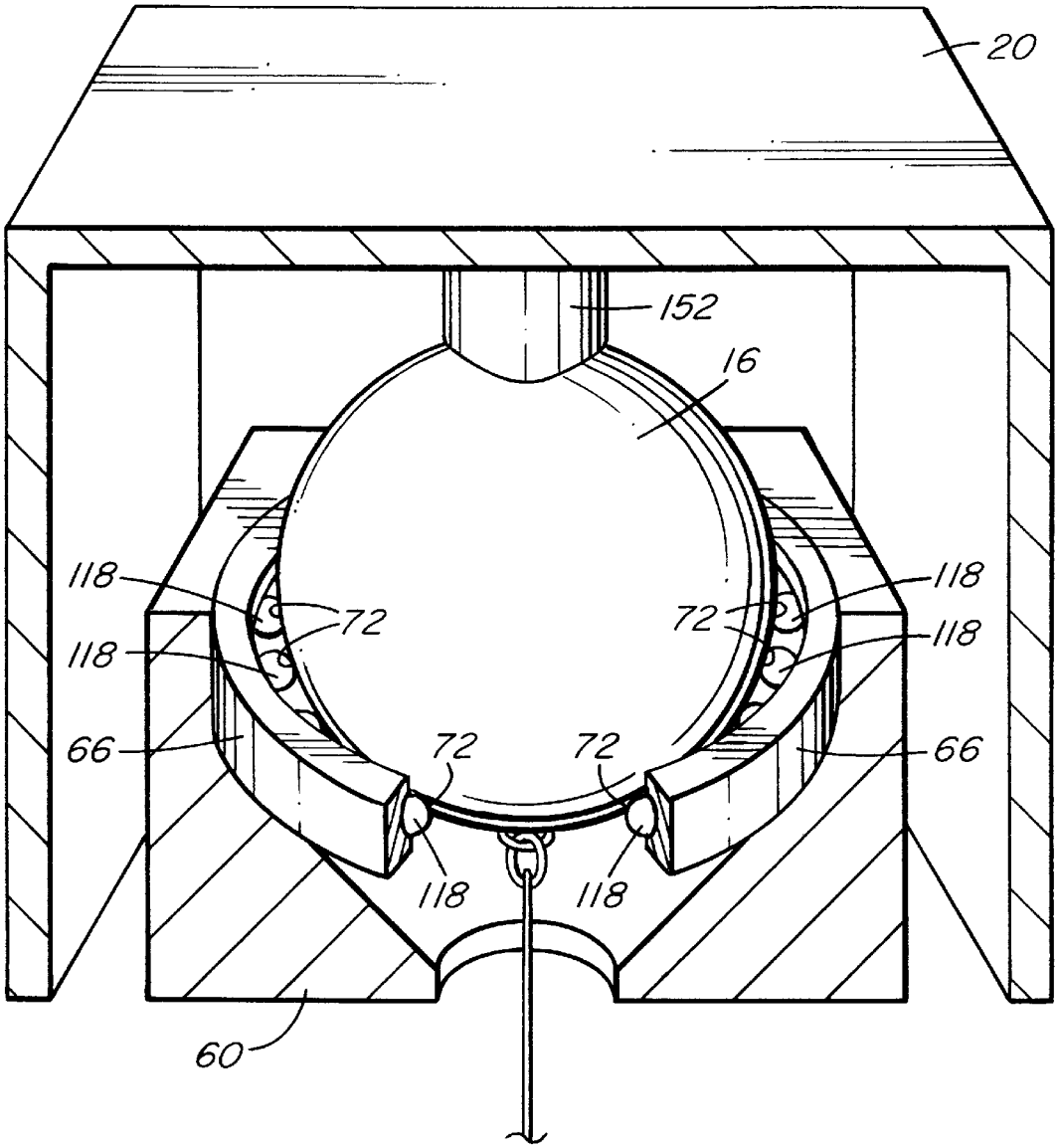
FIG. 8 is a close-up perspective view of the pivot member and ring of the joint of FIG. 1 wherein the upper portion of the ring is broken away to show the contact between the balls and the pivot member to pivotably support the pivot member in the ring.
Figure 9:
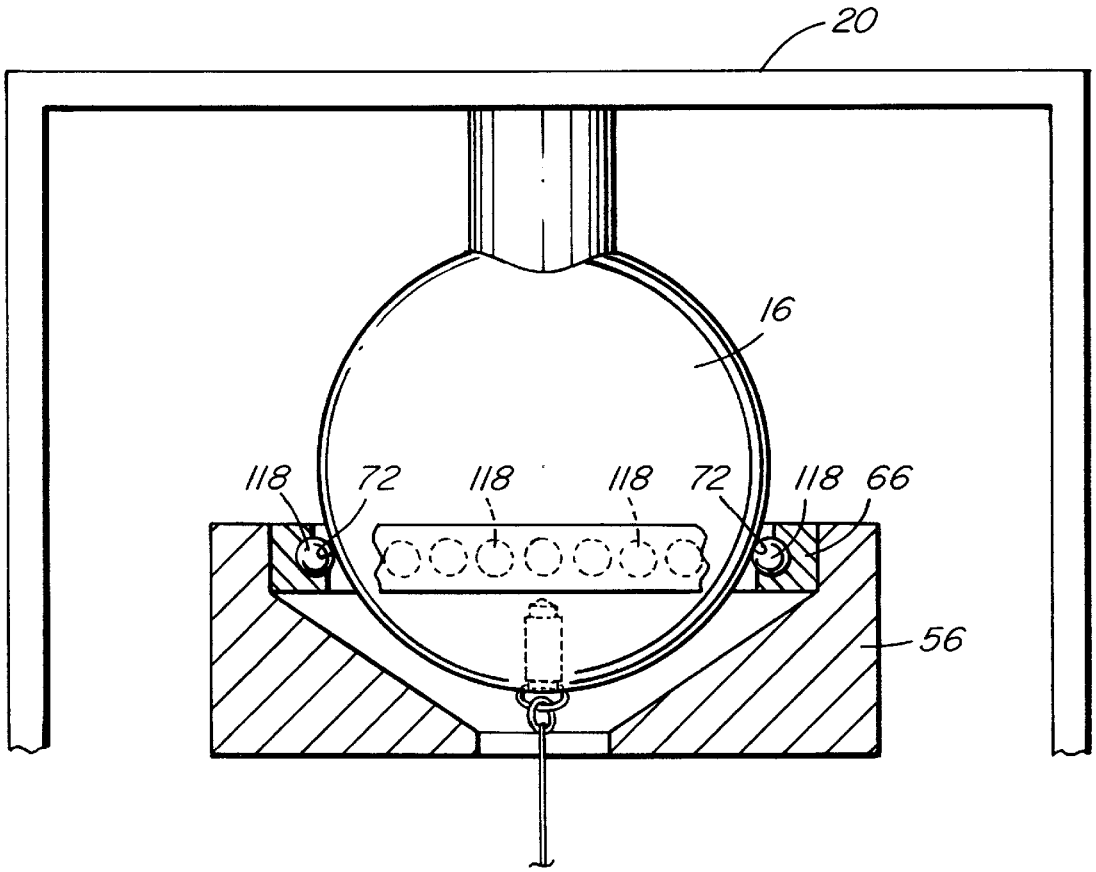
FIG. 9 is a close-up side view of the joint of FIG. 1 with parts of the ring broken away to show the contact between the balls and the pivot member to pivotably support the pivot member in the ring.

Ring 66 may be comprised of a ball bearing assembly to facilitate rotation of pivot member 16 within ring 66. As best seen in FIGS. 8 and 9, balls 118 of ball bearing assembly within ring 66 are rotatable in any direction within the ball bearing assembly. Balls 118 contact pivot contact surface 70 of pivot member 16 and retain and support pivot member 16 in ring 66. Where ring 66 is a ball bearing assembly, the annular ring contact surface 72 is comprised of the surfaces of all of the plurality of balls 118 of ring 66 which, at any particular time, contact pivot contact surface 70. However it should be understood that ring 66 does not necessarily have to be comprised of a ball bearing assembly. Instead any smooth surface of ring contact surface 72 permitting pivotable motion of pivot member 16 within ring 66, while supporting pivot member 16 within ring 66 and offering minimal resistance would provide a suitable interface between pivot contact surface 70 and ring contact surface 72. This could include plastic material or teflon coated material on both surface 70 and surface 72.

Connector 130 comprises cable 132 with swag end 134 at one end and the resistance force (not shown) at the other end of cable 132. Swag 134 fits within slot 86 and is pivotally secured therein.

Horizontal member 58 includes rotatable pulley 136 attached at an outer end. As seen in FIG. 5, bolt 138 extends through an opening in opposed flanges 140 of horizontal member 58. Nut 142 secures bolt 138 in place. A pair of flat washers 144 are interposed between pulley 136 and inner sides of flanges 140. Flat washer 146 is interposed between the outer face of one of flange 140 and bolt 138. Lock washer 148 is interposed between nut 142 and the outer side of the other of flange 140. Cable 132 extends downwardly from swag 134 about pulley 136 and then rearwardly to the resisting force.

Spring 150 is connected to inner sides of trigger members 88 and 90 to bias the trigger members 88 and 90 toward one another.

Pivot member 16 includes mount 152 extending upwardly and attached to upper side 20, thereby attaching pivot member 16 to mannequin 12. When joint 10 is in its normal position, mount 152 extends vertically above pivot member 16. Lower loop 154 is attached to the underside, in an area opposite mount 152 by means of screw 156. Loop 158 extends through loop 154 and is secured thereto. Short cable 160 extends from loop 158 at one end, to loop 162 at the other end. Loop 162, is in turn, connected to pin receiving loop 164 at a lower end. Pin 94 extends through loop 164 when pivot member 16 is secured to ring 66. It will be apparent that when loop 164 is secured by pin 94, the resisting force is connected to pivot member 16 thereby constraining pivot member 16 within ring 66. Deflection of mannequin 12, which causes deflection of pivot member 16 within ring 66 is further constrained by the resisting force with any deflection acting against that resisting force.

Operation:

The operation of joint 10 will now be discussed with reference to all the drawings. Referring first to FIGS. 1, 2 and 3, it will be seen that deflection of mannequin 12 causes equivalent deflection of pivot member 16 within ring 66. As seen best in FIG. 6, that deflection causes loop 154 to pull cable 160 upwardly and laterally. As pin 94 is contained within loop 164, this pulls pin 94 in an upward direction raising base 84 upwardly. This pulls swag end 134 upwardly pulling cable 132 and applying force against the force of the resisting force.

Figure 7:
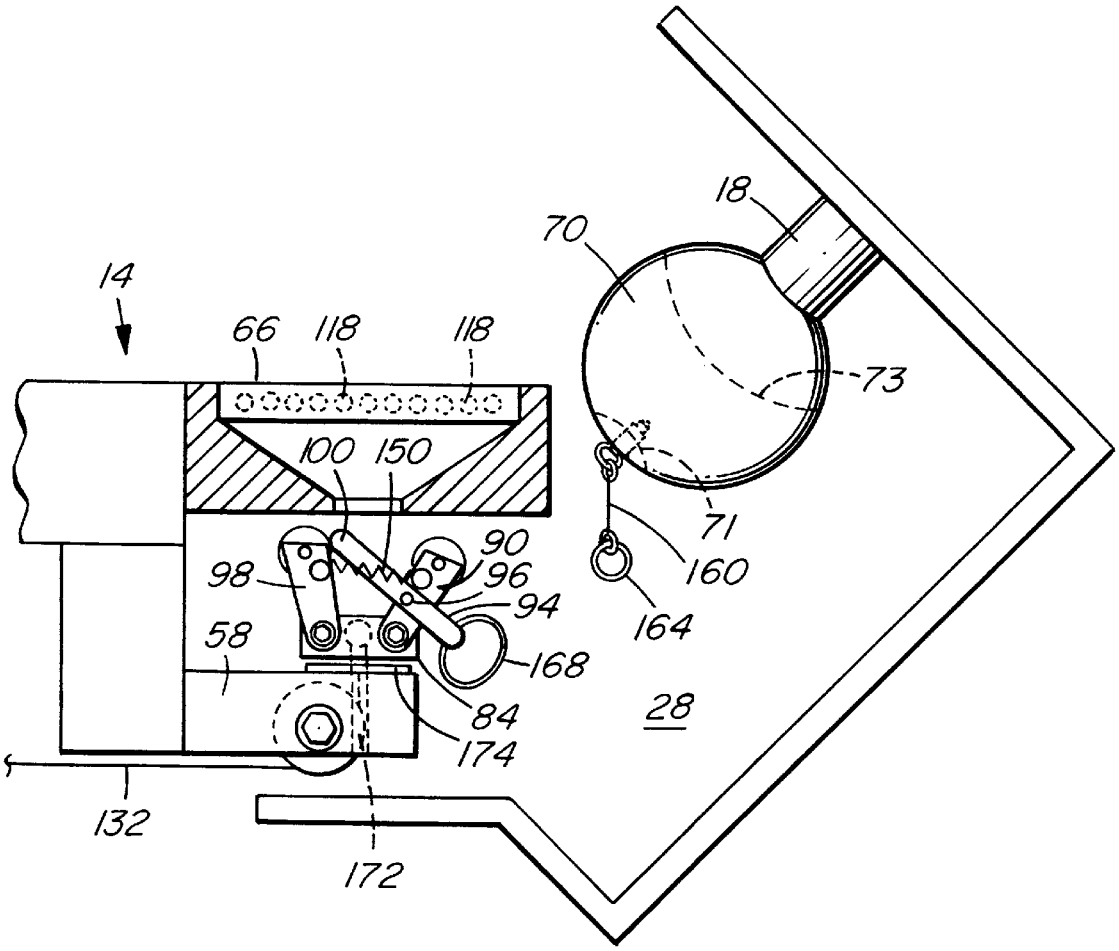
FIG. 7 is a close-up side view of the joint of FIG. 1 in a released position with the mannequin separated from the support.

Referring to FIGS. 4 through 7, when lock 116 is removed from position adjacent rollers 104, upward force on pin 94, caused by deflection of pivot member 16 causes rollers 104 to contact surface 62. Because trigger members 88 and 90 are oriented slightly outwardly from each other, continued upward force upon further deflection of pivot member 16 causes upper ends 106 of trigger members 88 and 90 to move outwardly along surface 62 ending up oriented substantially as depicted in FIG. 6. Outward movement is against the bias force exerted by spring 150. At some point during outward movement of trigger members 88 and 90, end 100 of pin 94 is released from slot 98. End 100 is then forced upwardly by ring 164. Ring 164 is free to slide along pin 94 which pivots about pivot connection 96. Loop 164 can then slide off pin 94 thereby releasing pin 94 from loop 164. This, in turn, releases base 84, and the resisting force from pivot member 16. Pivot member 16, together with cable 160 and loop 164 are then free to be removed from ring 66, as depicted in FIGS. 3 and 7.

Referring to FIG. 7, horizontal member 58 may include inner opening 172 extending vertically through member 58 through which cable 132 extends. Resisting force on cable 132 may then retain base 84 against pad 174 upon release of pivot member 16 from ring 66. This retains base 84 in close proximity to loop 164 when re-inserted in ring 66, ready for resetting.

The resetting of mannequin 12 on support 14 will now be described. Once the martial arts move has been completed, the user will replace mannequin 12 on support 14 for further use. As can be seen in FIG. 7, loop 164 hangs downwardly by force of gravity from pivot member 16. The user orients mannequin 12 such that cavity 28 is positioned surrounding support 14. The user then carefully raises mannequin 12 to position pivot member 16 above ring 66 and cavity 64 with loop 164 hanging downwardly axial of ring 66. Mannequin 12 is then lowered downwardly so that pivot member 16 rests in ring 66. Cable 160 and loop 164 should hang downwardly by force of gravity axial of ring 66 to be positioned centrally between trigger members 88 and 90. Mannequin 12 should be positioned in its upright or normal position such that loop 154 hangs downwardly from the lower apex of pivot member 16.

Note that trigger member 88 is biased toward trigger member 90 by spring 150. However, stop 166 prevents further inward movement of trigger member 88 past stop 166. The user then grasps head 168 of pin 94 to pull pin 94 and trigger member 90 outwardly away from trigger member 88 which is constrained from further inward movement by stop 166. The user can then move pin 94 about pivot connection 96 until end 100 is adjacent to loop 164. The user then allows the biasing force of spring 150 to move end 100 through loop 164 and then pivots pin 94 so that end 100 moves downwardly and slips into slot 98. It may be necessary to lift base 84 slightly, against the resisting force, to enable end 100 to be moved downwardly into slot 98, although this may not be necessary. Once end 100 is secured within slot 98 the resisting force acts on loop 164 to retain pivot member 16 within ring 66 in the normal position, as depicted in FIGS. 1 and 4. Lock 116 may be secured in position to prevent release of pivot member 16 from spring 66.

Mannequin 12 is thereby ready for use by the user in performing various martial arts, football, rugby or other body contact sports activities, including those requiring deflection of mannequin 12 and removal of mannequin 12 from support 14 in the manner described herein.

The previous description of the preferred embodiments is provided to enable any person skilled in the art to make or use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

I claim:

1. An apparitions releasably and pivotally connecting a target to a support, comprising:

a target, for user engagement a pivot member having a semi-spherically shaped pivot contact surface connected to the target;

an annular ring adapted to be connected to a support, comprising an annular ring contact surface for receiving the pivot member, the ring contact surface dimensioned to support the pivot member and to permit pivotal movement of the pivot member within the ring;

a resisting force;

a connector connecting the pivot member to the resisting force, the resisting force acting on the connector to constrain the pivot member within the ring against the ring contact surface and to permit pivotal movement of the pivot member within the ring against the force of the resisting force;

a release member acting on the connector to release the resisting force from the pivot member to permit removal of the pivot member from the ring upon the pivotal movement of the pivot member past a predetermined point.

2. The appatatus as described in claim 1 wherein the ring contact surface is located at an upper and inner part of the ring.

3. The apparatus as described in claim 2 wherein the ring contact surface faces upwardly and inwardly and contacts the pivot contact surface which is located at a lower outer surface of the pivot member.

4. The apparatus as described in claim 3 wherein the ring contact surface is shaped generally to conform to the pivot contact surface.

5. The apparatus as described in claim 1 wherein the resisting force, acting on the connector, maintains the pivot member in a normal position.

6. The apparatus as described in claim 5 wherein the normal position is upright.

7. The apparatus as described in claim 5 further comprising a mount for mounting the target to the pivot member the mount maintaining the mannequin in a generally upright orientation when the pivot member is in the normal position.

8. The apparatus as described in claim 5 wherein the connector is attached to the pivot member at a point substantially opposite to the point of attachment of the mount to the pivot member.

9. The apparatus as described in claim 1 wherein the resisting force and the pivot member are located at opposite ends of the connector.

10. The apparatus as described in claim 1 further comprising a stop to prevent pivotal movement of the pivot member beyond a second pre-determined point.

11. The apparatus as described in claim 10 wherein the second pre-determined point is further from the normal position as compared to the first pre-determined point.

12. The apparatus as described in claim 8 wherein the connector is attached to the sphere at the sphere's lowest point.

13. The apparatus as described in claim 8 wherein the connector comprises a longitudinal flexible strap.

14. The apparatus as described in claim 5 wherein the resisting force does not exert any force on the connector when the pivot member is in its normal position.

15. The apparatus as described in claim 1 wherein the ring contact surface comprises a ball bearing assembly to facilitate pivotal movement of the pivot member within the ring.

16. The apparatus as described in claim 15 wherein the balls of the ball bearing assembly support the pivot member in the ring.

17. The apparatus as described in claim 1 wherein the ring comprises a central ring opening defined by the ring and wherein the diameter of the ring opening is less than the diameter of the pivot member.

18. The apparatus as described in claim 1 wherein the release member comprises:

a release member base;

first and second opposed, generally upstanding trigger members pivotally connected to opposite ends of the base;

a release pin rotatably connected to the first trigger member;

a slot within the second trigger member dimensioned to accept an end of the release pin;

attachment means for attaching the release pin to the connector;

a contact member aligned with the trigger members whereby pivotal movement of the pivot member beyond the predetermined point causes the trigger members to contact the contact member and pivot outwardly in a direction away from one another to release the end of the release pin from the slot thereby releasing the resisting force from the pivot member.

19. The apparatus as described in claim 18 further comprising biasing means for biasing the release trigger members in an inward direction towards one another.

20. The apparatus as described in claim 19 wherein the biasing means is a spring.

21. The apparatus as described in claim 18 further comprising a connecting strap attached to the pivot member at one end and releasably connected to the pin at the other end.

22. The apparatus as described in claim 21 wherein the other end of the strap comprises a ring positioned to accept the release pin through the ring when the end of the release pin is in the slot to retain the strap connected to the resisting force and whereby the pin is removed from the ring when the trigger members are moved outwardly to release the end of the pin from the slot.

23. The apparatus as described in claim 18 further comprising a cable connected to the resisting force at one end and having a swag at the other end and wherein the base includes a slot for receiving the swag of the cable to connect the resisting force to the base.

24. The apparatus as described in claim 18 wherein the portion of the trigger members opposite to the end connected to the base each further comprise a rotatable member to facilitate outward movement of the trigger members when the contact member is contacted.

25. The apparatus as described in claim 18 further comprising lock means for preventing the release member from acting on the connector to release the resisting force from the pivot member.

26. The apparatus as described in claim 25 wherein the lock means is removable from the release member to permit the release member to act on the connector to release the resisting force from the pivot member.

27. The apparatus as described in claim 26 wherein the lock acts on the release member to prevent the trigger members from moving outwardly.

28. The apparatus as described in claim 18 wherein the trigger members are angled slightly outwardly from a vertical position to facilitate outward movement of the trigger members on contact with the contact member.

29. The apparatus as described in claim 18 wherein the contact member is above the trigger members and the trigger members are moved upwardly on deflection of the pivot member to contact the contact member.

30. The apparatus as described in claim 1 wherein the target is shaped to resemble a human.

* * * * *